US010959518B1

(12) United States Patent
Freedman

(10) Patent No.: US 10,959,518 B1
(45) Date of Patent: Mar. 30, 2021

(54) FURNISHING SELECTIVELY DEPLOYED AS A LUGGAGE RACK OR AS A VALET STAND

(71) Applicant: Eric H. Freedman, White Plains, NY (US)

(72) Inventor: Eric H. Freedman, White Plains, NY (US)

( * ) Notice: Subject to any disclaimer, the term of this patent is extended or adjusted under 35 U.S.C. 154(b) by 0 days.

(21) Appl. No.: 16/685,095

(22) Filed: Nov. 15, 2019

(51) Int. Cl.

| | |
|---|---|
| ***A47B 85/06*** | (2006.01) |
| ***A47G 25/06*** | (2006.01) |
| ***A47C 7/64*** | (2006.01) |
| ***A47B 3/087*** | (2006.01) |
| ***A47B 3/02*** | (2006.01) |

(52) U.S. Cl.
CPC ..... *A47B 85/06* (2013.01); *A47B 3/02* (2013.01); *A47B 3/087* (2013.01); *A47C 7/64* (2013.01); *A47G 25/0671* (2013.01); *A47G 25/0685* (2013.01); *A47B 2200/0015* (2013.01); *A47B 2200/0035* (2013.01)

(58) Field of Classification Search
CPC ..... A47B 85/06; A47B 2200/0055; A47B 46/005; A47B 43/02; A47B 55/06; A47B 61/06; A47C 7/64; A47G 25/0664; A47G 25/0671; A47G 25/0685
USPC ..... 108/11, 12, 13, 14, 15, 16; 211/195, 211/196, 118, 70.1
See application file for complete search history.

(56) References Cited

U.S. PATENT DOCUMENTS

| | | | | | |
|---|---|---|---|---|---|
| 229,600 | A | | 7/1880 | Freeborn et al. | |
| 358,486 | A | * | 3/1887 | Seibert | A47B 85/08 312/240 |
| 786,526 | A | * | 4/1905 | Sollom | A47B 85/06 108/15 |
| 892,422 | A | * | 7/1908 | Hearn | A47B 31/04 108/16 |
| 2,608,304 | A | | 8/1952 | Simjian | |
| 2,991,122 | A | * | 7/1961 | Boo | A47C 13/00 297/3 |
| 3,095,834 | A | * | 7/1963 | Killen | A47B 97/04 108/15 |
| 3,144,940 | A | | 8/1964 | Barnett et al. | |
| 3,149,879 | A | | 9/1964 | Steiber | |
| 3,189,380 | A | | 6/1965 | Reguitti | |
| D205,667 | S | | 9/1966 | Rubens | |
| 3,692,358 | A | * | 9/1972 | Sung | A47B 3/02 297/158.4 |
| 4,229,038 | A | * | 10/1980 | Drost | A47B 3/02 108/173 |
| 4,574,990 | A | * | 3/1986 | Remis | A45C 3/00 190/8 |
| 5,052,308 | A | | 10/1991 | Brown | |
| 5,584,254 | A | * | 12/1996 | Williams | A47B 3/02 108/118 |

(Continued)

FOREIGN PATENT DOCUMENTS

| | | | | |
|---|---|---|---|---|
| CA | 2430550 | A1 * | 11/2003 | A47G 25/16 |

*Primary Examiner* — Jose V Chen
(74) *Attorney, Agent, or Firm* — Richard M. Goldberg

(57) ABSTRACT

A furnishing construction and a method accomplish selective conversion of the furnishing between a compact folded structure providing a valet stand, and an expanded unfolded structure providing a luggage rack. The folded structure easily is stored in a minimal space, and readily is moved to a convenient location to serve as a valet stand, or unfolded to serve as a luggage rack.

22 Claims, 3 Drawing Sheets

(56) References Cited

U.S. PATENT DOCUMENTS

| | | | | | |
|---|---|---|---|---|---|
| 5,628,551 | A * | 5/1997 | Block | A47B 81/00 | 297/126 |
| 5,683,135 | A * | 11/1997 | Williams | A47B 3/14 | 108/118 |
| 5,819,961 | A | 10/1998 | Harris | | |
| D407,235 | S * | 3/1999 | Cunningham | D6/692.1 | |
| 6,073,783 | A | 6/2000 | Allman | | |
| 6,443,074 | B1 * | 9/2002 | Adams | A47B 3/02 | 108/118 |
| 6,443,321 | B1 | 9/2002 | Felsenthal | | |
| 7,063,381 | B2 * | 6/2006 | Scahill | A47C 7/64 | 224/275 |
| 7,077,276 | B1 | 7/2006 | Romano | | |
| 7,765,941 | B2 | 8/2010 | Chen | | |
| 9,919,196 | B2 * | 3/2018 | Gellman | A47F 7/19 | |
| 2004/0025759 | A1 * | 2/2004 | Lee | A47B 3/02 | 108/118 |

* cited by examiner

FURNISHING SELECTIVELY DEPLOYED AS A LUGGAGE RACK OR AS A VALET STAND

The present invention relates generally to furnishings for accommodating patrons of hotels, motels, inns and other facilities that provide temporary lodging, and pertains, more specifically, to providing such facilities with a selectively deployed luggage rack or valet stand.

Hotels, motels, inns and the like that provide temporary lodging usually offer patrons furnishings that enhance a person's temporary stay at such facilities. Among such furnishings are luggage racks, for the convenient placement and access to a traveler's baggage, and valet stands for suitable temporary placement of apparel. Often, space is limited at the facility and it becomes necessary to limit the availability of such amenities.

The present invention provides either a sturdy luggage rack or an effective valet stand in a conveniently stored and readily deployed single furnishing. As such the present invention attains several objects and advantages, some of which are summarized as follows: Provides a furnishing that is advantageously stored in a compact form and either is erected readily to establish a sturdy luggage rack or is put in place as a versatile valet stand; makes available to a patron of a lodging facility a single item enabling the convenient selection of a luggage rack or a valet stand; provides a furnishing easily converted from a compact configuration for convenient storage or use as a versatile valet stand to a sturdy luggage rack; allows a lodging facility to offer a patron the convenience of a readily available sturdy luggage rack or a versatile valet stand, or both, with ease and economy; enables the conservation of usable space in a lodging facility, while still offering the use of either or both of a luggage rack and a valet stand; provides a highly versatile furnishing of simple and economical construction for use as a luggage rack or a valet stand; provides a furnishing of simple, economical and rugged construction capable of exemplary performance as a luggage rack or a valet stand over an extended service life.

The above objects and advantages, as well as further objects and advantages, are attained by the present invention which may be described briefly as a furnishing for selective conversion between a compact folded structure providing a valet stand, and an expanded unfolded structure providing a luggage rack, the furnishing comprising: a basal construct having at least a first leg assembly including first and second legs, the first and second legs each having a length extending between an upper end and a lower end; a first pivotal connection coupling the first and second legs for pivotal movement about a first pivotal axis located intermediate the upper and lower ends of the first and second legs, between a folded configuration, wherein the upper ends are juxtaposed with one-another, and the lower ends are juxtaposed with one-another, thereby establishing a standard, and an unfolded configuration, wherein the upper ends are spaced apart longitudinally from one-another, and the lower ends are spaced apart longitudinally from one-another, thereby establishing a support base; a first platform construct having a first end, a second end spaced longitudinally from the first end, laterally spaced apart sides and a first platform member extending longitudinally between the first end and the second end of the first platform construct; a second pivotal connection coupling the first platform construct with the first leg of the leg assembly for pivotal movement about a second pivotal axis located adjacent the first end of the first platform construct in juxtaposition with the upper end of the first leg of the leg assembly; a second platform construct having a first end, a second end spaced longitudinally from the first end, laterally spaced apart sides and a second platform member extending between the first end and the second end of the second platform construct; a third pivotal connection coupling the second platform construct with the second leg of the leg assembly for pivotal movement about a third pivotal axis located adjacent the first end of the second platform construct in juxtaposition with the upper end of the second leg of the leg assembly; a fourth pivotal connection coupling the first and second platform constructs with one-another for pivotal movement about a fourth pivotal axis located between the second and third pivotal axes; whereby upon placement of the leg assembly in the unfolded configuration, the first and second platform constructs are aligned in a horizontal orientation, extended along a substantially horizontal common line, with the second end of the first platform construct juxtaposed with the second platform construct, thereby establishing a platform supported along the substantially horizontal common line at an elevated location by the support base; and stabilizing feet comprising a stabilizing foot at the lower end of each leg, each stabilizing foot extending transverse to the length of a corresponding leg; whereby upon selective raising of the fourth pivotal axis to an elevation above the second and third pivotal axes to move the leg assembly into the folded configuration, the first and second platform members are moved pivotally about the respective second, third and fourth pivotal axes, out of the horizontal orientation and into an overlapping vertical orientation, and the first and second legs are moved to establish the standard supported by an extended footprint provided by the stabilizing feet, thereby establishing the valet stand.

In addition, the invention provides a method for selective conversion of a furnishing between a compact folded structure providing a valet stand, and an expanded unfolded structure providing a luggage rack, the method comprising: providing a basal construct having at least a first leg assembly including first and second legs, the first and second legs each having a length extending between an upper end and a lower end; coupling the first and second legs for pivotal movement about a first pivotal axis located intermediate the upper and lower ends of the first and second legs, between a folded configuration, wherein the upper ends are juxtaposed with one-another, and the lower ends are juxtaposed with one-another, thereby establishing a standard, and an unfolded configuration, wherein the upper ends are spaced apart longitudinally from one-another, and the lower ends are spaced apart longitudinally from one-another, thereby establishing a support base; providing a first platform construct having a first end, a second end spaced longitudinally from the first end, laterally spaced apart sides and a first platform member extending longitudinally between the first end and the second end of the first platform construct; coupling the first platform construct with the first leg of the leg assembly for pivotal movement about a second pivotal axis located adjacent the first end of the first platform construct in juxtaposition with the upper end of the first leg of the leg assembly; providing a second platform construct having a first end, a second end spaced longitudinally from the first end, laterally spaced apart sides and a second platform member extending between the first end and the second end of the second platform construct; coupling the second platform construct with the second leg of the leg assembly for pivotal movement about a third pivotal axis located adjacent the first end of the second platform construct in juxtaposition with the upper end of the second leg of the leg assembly; and coupling the first and second platform constructs with one-another for pivotal movement about a fourth pivotal axis located between the second and third pivotal axes; whereby upon placement of the leg assembly in the unfolded configuration, the first and second platform constructs are aligned in a horizontal orientation, extended along a substantially horizontal common line, with the second end of the first platform construct juxtaposed with the second platform construct, establishing a platform supported along the substantially horizontal common line at an elevated location by the support base; and providing a stop construct positioned to preclude downward movement of the platform below the elevated location, thereby establishing the luggage rack; and providing stabilizing feet comprising a stabilizing foot at the lower end of each leg, and extending each stabilizing foot transverse to the length of a corresponding leg; whereby upon selectively raising of the fourth pivotal axis to an elevation above the second and third pivotal axes to move the leg assembly into the folded configuration, the first and second platform members are moved pivotally about the respective second, third and fourth pivotal axes, out of the horizontal orientation and into an overlapping vertical orientation, and the first and second legs are moved to establish the standard supported by an extended footprint provided by the stabilizing feet, thereby establishing the valet stand.

The invention will be understood more fully, while still further objects and advantages will become apparent, in the following detailed description of preferred embodiments of the invention, in which.

Figure 1:
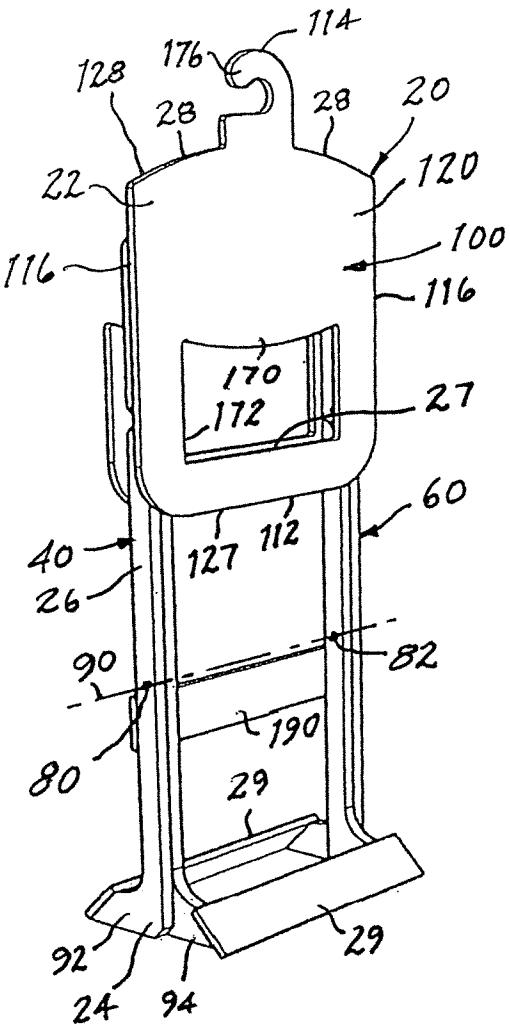
FIG. 1 is a top, front and left side pictorial view of a furnishing constructed in accordance with the present invention, shown in a selected structural configuration.
Figure 2:
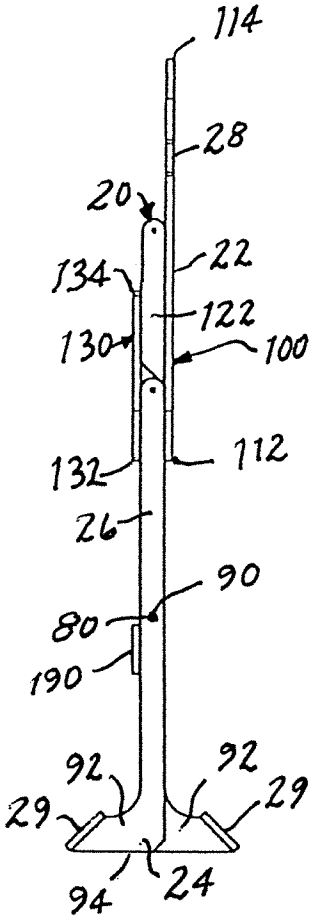
FIG. 2 is a left side elevational view of the furnishing in the structural configuration illustrated in FIG. 1.
Figure 3:
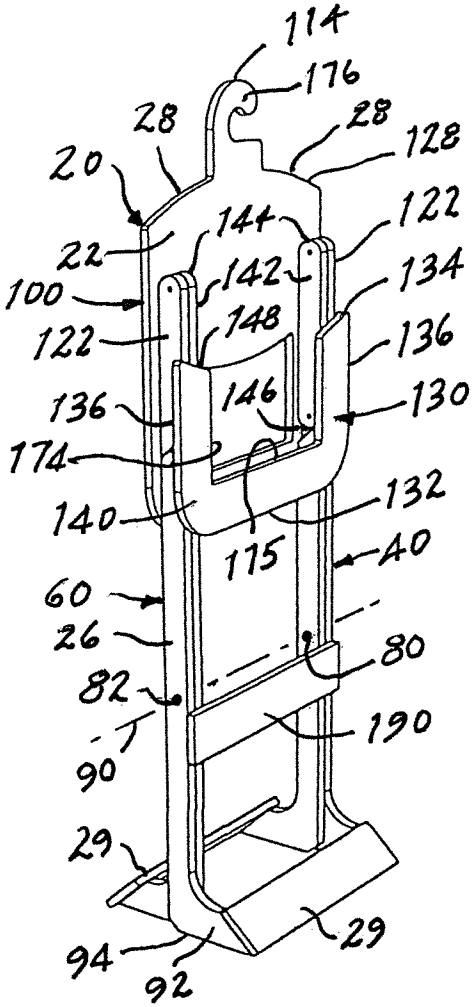
FIG. 3 is a top, rear and right side pictorial view of the furnishing in the structural configuration illustrated in FIG. 1.
Figure 4:
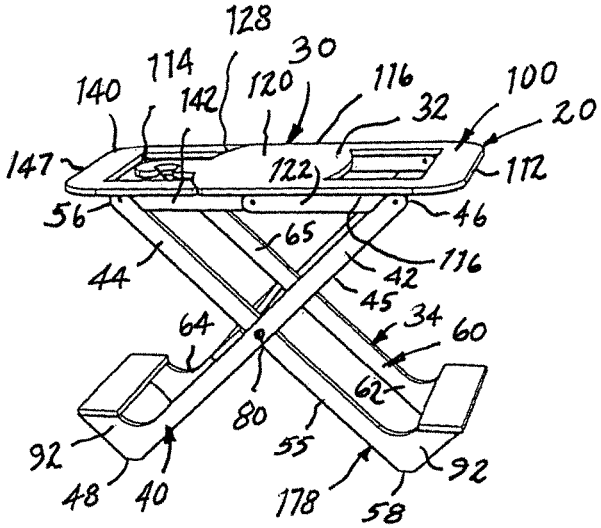
FIG. 4 is a top, front and left side pictorial view of the furnishing shown in another selected structural configuration.
Figure 5:
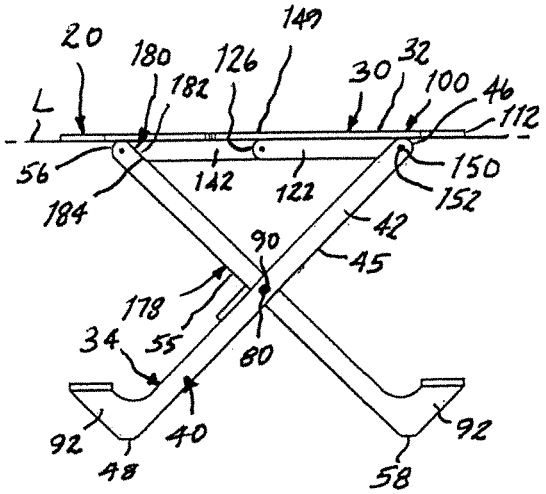
FIG. 5 is a left side elevational view of the furnishing in the structural configuration illustrated in FIG. 4.
Figure 6:
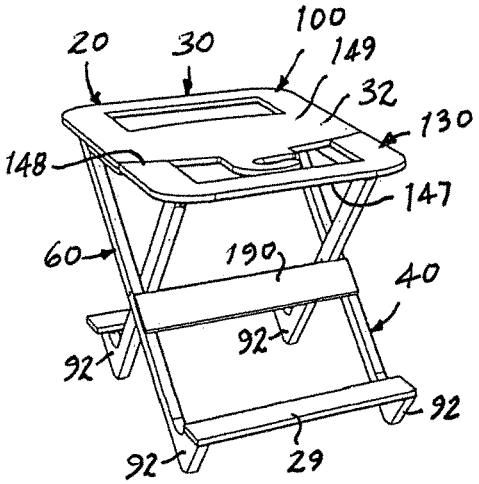
FIG. 6 is a top, rear and right side pictorial view of the furnishing in the structural configuration illustrated in FIG. 4.
Figure 7:
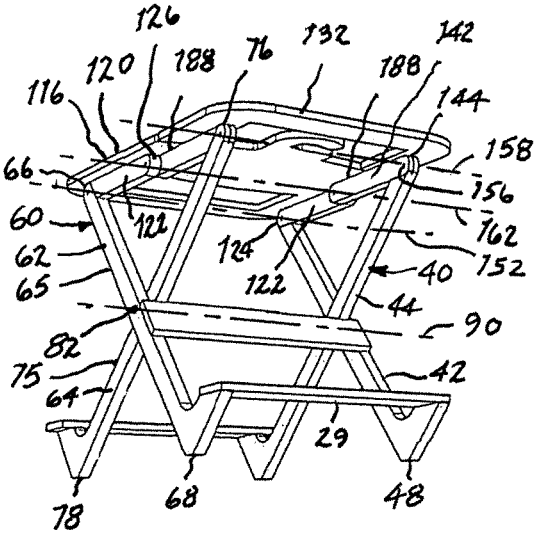
FIG. 7 is a bottom, rear and right side pictorial view of the furnishing in the structural configuration illustrated in FIG. 4.

Referring now to the drawing, and especially to FIGS. 1 through 3 thereof, a furnishing constructed in accordance with the present invention is illustrated at 20 and is shown in the form of a valet stand 22 having a base 24, a standard 26, a ledge 27 and shoulders 28 supported by the standard 26 at an altitudinal location vertically above base 24. Ledge 27 is in place for the reception of garments such as pants and skirts (not shown), and shoulders 28 are contoured so as to provide a desired profile configuration for the reception of garments such as jackets, shirts and blouses (not shown), any when draped over valet stand 22 in the manner ordinarily provided by a conventional valet stand. At the same time, angled basal members 29 are made available for the reception of footwear (not shown) in a now conventional manner.

With reference now to FIGS. 4 through 7, as well as to FIGS. 1 through 3, furnishing 20 is selectively converted from valet stand 22 into a luggage rack 30 having a platform 32, supported at an elevated location by a basal construct 34 for the reception of items of luggage (not shown) in a now conventional manner. Basal construct 34 includes a first leg assembly 40 having a first leg 42 and a second leg 44. First leg 42 has a length 45 extending between an upper end 46 and a lower end 48, while second leg 44 has a length 55 extending between an upper end 56 and a lower end 58. A second leg assembly 60 of the basal construct 34 is spaced laterally from the first leg assembly 40 and includes a first leg 62 and a second leg 64. First leg 62 has a length 65 extending between an upper end 66 and a lower end 68, while second leg 64 has a length 75 extending between an upper end 76 and a lower end 78.

First and second legs 42 and 44 of first leg assembly 40 are coupled together by a pivotal connection 80 located intermediate the upper and lower ends 46 and 48 of the first leg 42 and intermediate the upper and lower ends 56 and 58 of second leg 44. Likewise, first and second legs 62 and 64 of second leg assembly 60 are coupled together by a pivotal connection 82 located intermediate the upper and lower ends 66 and 68 of first leg 62 and intermediate the upper and lower ends 76 and 78 of second leg 64. Pivotal connections 80 and 82 are located along a common, laterally extending first pivotal axis 90. Each leg 42, 44, 62 and 64 terminates at a foot 92 extending transverse to the length of the respective leg, at each lower end 48, 58, 68 and 78, such that the feet 92 establish an extended basal footprint 94 at the base 24 for stabilizing the furnishing 20 when in the form of valet stand 22.

A first platform construct 100 extends longitudinally between a first end 112 and a second end 114 of the first platform construct 100, and laterally between spaced apart sides 116. First platform construct 100 includes a first platform member 120 affixed to first links 122 located one first link 122 adjacent each side 116. Each first link 122 extends between a first end 124 and a second end 126. First platform member 120 has a first end 127 and terminates at a second end in the form of terminal end 128 which is shaped to provide shoulders 28 with a convex contour configuration adapted for appropriately supporting a garment of the type described above when furnishing 20 is in the form of valet stand 22.

A second platform construct 130 extends longitudinally between a first end 132 and a second end 134 and laterally between spaced apart sides 136. The second platform construct 130 includes a second platform member 140 affixed to second links 142 located one second link 142 adjacent each side 136. Each second link 142 extends between a first end 144 and a second end 146. Second platform member 140 includes a first end 147 and terminates at a second end in the form of terminal end 148 which preferably includes a shape essentially complementary to that of terminal end 128 of first platform member 120 so as to adjoin first platform member 120 to provide platform 32 with an essentially smooth and uninterrupted upper support surface 149 extending across terminal ends 128 and 148, thereby facilitating manipulation of an item of luggage placed on support surface 149.

Each first link 122 is coupled adjacent a corresponding first end 124 to a counterpart leg assembly 40, 60 in juxtaposition with a corresponding upper end 46, 66 of respective legs 42 and 64 by a pivotal connection 150 for pivotal movement of the first platform construct 100 about a second pivotal axis 152. Each second link 142 is coupled adjacent a corresponding first end 144 to a counterpart leg assembly 40, 60 in juxtaposition with a corresponding upper end 46, 76 of respective legs 44 and 64 by a pivotal connection 156 for pivotal movement of the second platform construct 130 about a third pivotal axis 158. Each first link 122 is coupled to a counterpart second link 142 by a pivotal connection 160 adjacent respective second ends 126 and 146 of the first and second links 122 and 142 for relative pivotal movement between the first and second platform constructs 100 and 130 about a fourth pivotal axis 162.

Figure 8:
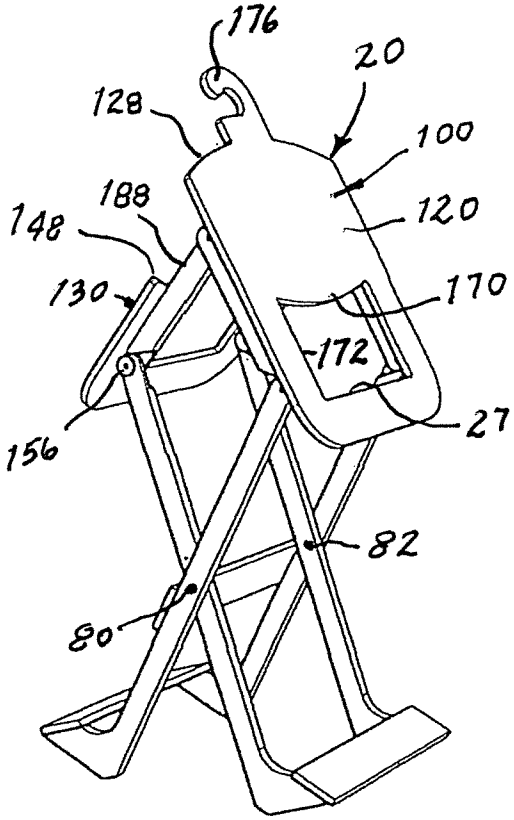
FIG. 8 is a top, front and left side pictorial view of the furnishing in an intermediate stage.
Figure 9:
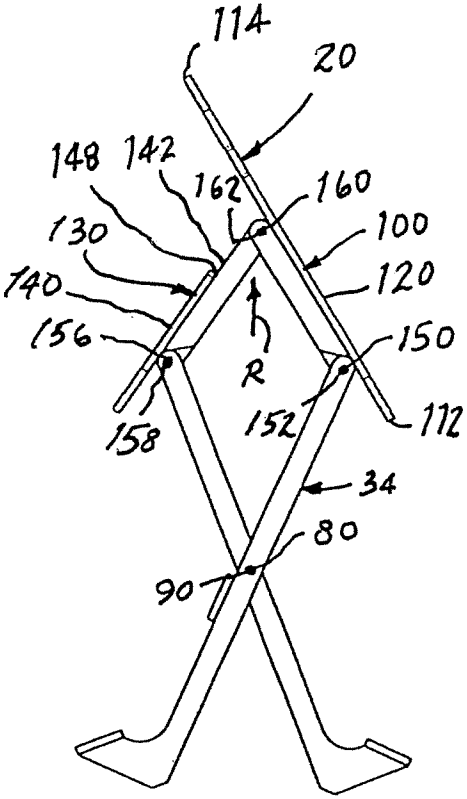
FIG. 9 is a left side elevational view of the furnishing in the intermediate stage illustrated in FIG. 8.
Figure 10:
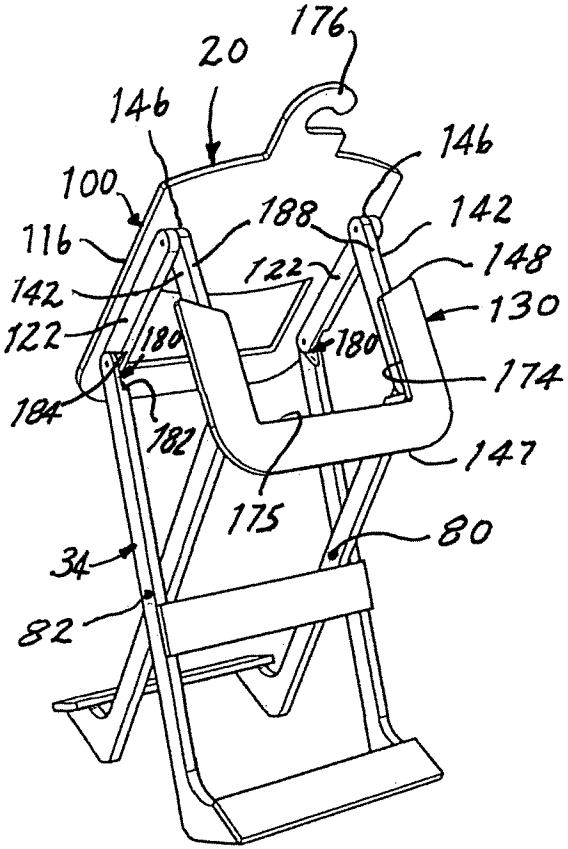
FIG. 10 is a top, rear and right side pictorial view of the furnishing in the intermediate stage illustrated in FIG. 8.

Turning now to FIGS. 8 through 10, when it is desired to convert furnishing 20 from the luggage rack 30 to the valet stand 22, the fourth pivotal axis 162 is lifted, in the direction of arrow R, as seen in FIG. 9, facilitated by a handgrip 170, readily accessed at an opening 172 in first platform member 120, so as to raise fourth pivotal axis 162 above second and third pivotal axes 152 and 158, thereby folding basal construct 34 and moving the first and second platform constructs 100 and 130 and, consequently, the first and second platform members 120 and 140, pivotally about the respective pivotal axes 152, 158 and 162 into an overlapping vertical orientation, supported by the first and second leg assemblies 40 and 60, each having been pivoted about first pivotal axis 90 into a fully folded configuration establishing the standard 26 illustrated in FIGS. 1 through 3.

Upon return of the furnishing 20 to the compact configuration illustrated in FIGS. 1 through 3, transport of furnishing 20 to or from a convenient storage area is assisted by the ability to grasp furnishing 20 at handgrip 170, full access to handgrip 170 being made available by opening 174 in second platform member 140. Opening 174 is aligned with opening 172 and provides a further ledge 175 for the reception of a garment draped at ledge 27. Upon arrival of furnishing 20 at a storage area, in the compact, folded configuration, storage is facilitated by the provision of a hook 176 extending from terminal end 124 of first platform member 124, enabling furnishing 20 to be suspended on a wall or in another limited space, such as within a closet, suspended from a closet bar. Hook 176 also is available for grasping to assist in lifting fourth pivotal axis 162 as described in connection with the aforesaid conversion of furnishing 20 from luggage rack 30 to valet stand 22.

Upon selected return of furnishing 20 from the fully folded configuration illustrated in FIGS. 1 through 3, wherein furnishing 20 can serve as valet stand 22, to the unfolded configuration illustrated in FIGS. 4 through 7, wherein furnishing 20 can serve as luggage rack 30, first and second platform constructs 100 and 130 are moved into an end-to-end alignment along a substantially horizontal common line L, as seen in FIGS. 4 through 7, with the first and second platform members 120 and 140 set in a horizontal orientation establishing platform 32 supported at an elevated location by the first and second leg assemblies 40 and 60, each having been readily unfolded by grasping first and second platform constructs 100 and 130 at respective first ends 112 and 134 and pivoting the legs 42, 44, 62 and 64 about first pivotal axis 90, until each leg assembly 40 and 60 is placed in the unfolded configuration establishing a support base 178 provided by the unfolded basal construct 34. In the preferred construction, terminal end 128 of first platform member 120 and terminal end 148 of second platform member 140 bear complementary configurations so that the first and second platform members 120 and 140 become flush and present a smooth, even surface at upper support surface 149.

Movement of the first and second platform members 120 and 140 downwardly beyond line L is precluded by a stop construct that includes either one or both of a first stop mechanism 180 comprised of confronting stop abutments 182 and 184 placed at one or more of the pivotal connections, and a second stop mechanism in which the terminal end 128 of the first platform member 120 extends beyond the fourth pivotal axis 162, and the terminal end 148 of the second platform member 140 is spaced away from the fourth pivotal axis 162 to expose portions 188 of second links 142 for engagement by the first platform member 120, thereby precluding further downward movement of the platform members 120 and 140 and maintaining the integrity of platform 32 as fully supported by basal construct 34. At the same time, a crossbar 190 is affixed to the first leg 42 and 62 of each leg assembly 40 and 60 in position to serve as a further stop mechanism precluding further downward movement of first and second platform constructs 100 and 130 and to reinforce the relative lateral positions of the first and second leg assemblies 40 and 60 when the basal construct 34 is in the unfolded configuration illustrated in FIGS. 4 through 7, ready to accept a load on platform 32. The integrity of basal construct 34 is further enhanced by crossbar 190 as well as by basal members 29.

It will be seen that the present invention attains all of the objects and advantages summarized above, namely: Provides a furnishing that is advantageously stored in a compact form and either is erected readily to establish a sturdy luggage rack or is put in place as a versatile valet stand; makes available to a patron of a lodging facility a single item enabling the convenient selection of a luggage rack or a valet stand; provides a furnishing easily converted from a compact configuration for convenient storage or use as a versatile valet stand to a sturdy luggage rack; allows a lodging facility to offer a patron the convenience of a readily available sturdy luggage rack or a versatile valet stand, or both, with ease and economy; enables the conservation of usable space in a lodging facility, while still offering the use of either or both of a luggage rack and a valet stand; provides a highly versatile furnishing of simple and economical construction for use as a luggage rack or a valet stand; provides a furnishing of simple, economical and rugged construction capable of exemplary performance as a luggage rack or a valet stand over an extended service life.

It is to be understood that the above description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A furnishing for selective conversion between a compact folded structure providing a valet stand, and an expanded unfolded structure providing a luggage rack, the furnishing comprising:

a basal construct having at least a first leg assembly including first and second legs, the first and second legs each having a length extending between an upper end and a lower end;

a first pivotal connection coupling the first and second legs for pivotal movement about a first pivotal axis located intermediate the upper and lower ends of the first and second legs, between a folded configuration, wherein the upper ends are juxtaposed with one-another, and the lower ends are juxtaposed with one-another, thereby establishing a standard, and an unfolded configuration, wherein the upper ends are spaced apart longitudinally from one-another, and the lower ends are spaced apart longitudinally from one-another, thereby establishing a support base;

a first platform construct having a first end, a second end spaced longitudinally from the first end, laterally spaced apart sides and a first platform member extending longitudinally between the first end and the second end of the first platform construct;

a second pivotal connection coupling the first platform construct with the first leg of the leg assembly for pivotal movement about a second pivotal axis located adjacent the first end of the first platform construct in juxtaposition with the upper end of the first leg of the leg assembly;

a second platform construct having a first end, a second end spaced longitudinally from the first end, laterally spaced apart sides and a second platform member extending between the first end and the second end of the second platform construct;

a third pivotal connection coupling the second platform construct with the second leg of the leg assembly for pivotal movement about a third pivotal axis located adjacent the first end of the second platform construct in juxtaposition with the upper end of the second leg of the leg assembly;

a fourth pivotal connection coupling the first and second platform constructs with one-another for pivotal movement about a fourth pivotal axis located between the second and third pivotal axes;

whereby upon placement of the leg assembly in the unfolded configuration, the first and second platform constructs are aligned in a horizontal orientation, extended along a substantially horizontal common line, with the second end of the first platform construct juxtaposed with the second platform construct, thereby establishing a platform supported along the substantially horizontal common line at an elevated location by the support base;

a stop construct positioned in juxtaposition with at least one of the first pivotal connection, the second pivotal connection, the third pivotal connection, and the fourth pivotal connection, to preclude downward movement of the platform below the elevated location, thereby establishing the luggage rack; and stabilizing feet comprising a stabilizing foot at the lower end of each leg, each stabilizing foot extending transverse to the length of a corresponding leg;

whereby upon selective raising of the fourth pivotal axis to an elevation above the second and third pivotal axes to move the leg assembly into the folded configuration, the first and second platform members are moved pivotally about the respective second, third and fourth pivotal axes, out of the horizontal orientation and into an overlapping vertical orientation, and the first and second legs are moved to establish the standard supported by an extended footprint provided by the stabilizing feet, thereby establishing the valet stand.

2. The furnishing of claim 1 wherein the stop construct comprises confronting stop abutments placed at least at one of the second and third pivotal connections and arranged for engagement upon placement of the leg assembly in the unfolded configuration to preclude downward movement of the platform below the elevated location.

3. The furnishing of claim 1 wherein the stop construct comprises confronting stop abutments placed at both of the second and third pivotal connections and arranged for engagement upon placement of the leg assembly in the unfolded configuration to preclude downward movement of the platform below the elevated location.

4. The furnishing of claim 1 wherein the stop construct comprises an arrangement wherein the fourth pivotal axis is positioned adjacent the second end of the second platform construct and located between the first and second ends of the first platform construct such that upon alignment of the first and second platform members in the horizontal orientation, the second end of the first platform construct is engaged with the second platform construct between the fourth pivotal axis and the third pivotal axis to preclude downward movement of the platform below the elevated location.

5. The furnishing of claim 1 wherein the stop construct comprises an arrangement wherein the first platform member extends from a first end adjacent the second pivotal axis to a second end spaced beyond the fourth pivotal axis toward the third pivotal axis, and the second platform member extends from a first end adjacent the third pivotal axis to a second end spaced from the fourth pivotal axis toward the third pivotal axis such that upon placement of the first and second platform constructs along the substantially horizontal common line, the second end of the first platform member engages the second platform construct between the fourth pivotal axis and the third pivotal axis to preclude downward movement of the platform below the elevated location.

6. The furnishing of claim 5 wherein the second end of the second platform member is spaced away from the fourth pivotal axis toward the third pivotal axis such that the second end of the first platform member engages the second platform construct between the second end of the second platform member and the fourth pivotal axis.

7. The furnishing of claim 6 wherein the first platform construct includes at least one first link extending longitudinally beneath the first platform member, the second platform construct includes at least one second link extending longitudinally beneath the second platform member, the first and second links being coupled with one-another for pivotal movement about the fourth pivotal axis such that upon placement of the first platform construct along the substantially horizontal common line, the first platform member engages the second link between the fourth pivotal axis and the second end of the second platform member thereby establishing the platform along the substantially horizontal common line.

8. The furnishing of claim 1 wherein the second end of the first platform member includes a convex profile contour configuration for the reception of a garment when the furnishing is configured in the folded structure.

9. The furnishing of claim 8 including an opening in the first platform member providing a ledge adjacent the first end of the first platform member for the reception of a further garment when the furnishing is configured in the folded structure.

10. The furnishing of claim 1 including a hook placed at the second end of the first platform member for facilitating hanging of the furnishing when the furnishing is configured in the folded structure.

11. The furnishing of claim 1 including a handgrip located on at least one of the first and second platform constructs for facilitating transport of the furnishing when the furnishing is configured in the folded structure.

12. The furnishing of claim 1 wherein the basal construct includes a second leg assembly spaced laterally from the first leg assembly, the second leg assembly having respective first and second legs, the respective first and second legs each having a length extending between a respective upper end and a respective lower end;

a further pivotal connection located intermediate the upper and lower ends of the first and second legs of the second leg assembly and coupling the first and second legs of the second leg assembly for pivotal movement about the first pivotal axis, between a respective folded configuration, wherein the respective upper ends are juxtaposed with one-another, and the respective lower ends are juxtaposed with one-another, thereby further establishing the standard, and a respective unfolded configuration, wherein the respective upper ends are spaced apart longitudinally from one-another, and the respective lower ends are spaced apart longitudinally from one-another, thereby further establishing the support base;

a still further pivotal connection located in juxtaposition with the upper end of the first leg of the second leg assembly and coupling the first platform construct with the first leg of the second leg assembly for pivotal movement about the second pivotal axis;

an additional pivotal connection located in juxtaposition with the upper end of the second leg of the second leg assembly and coupling the second platform construct with the second leg of the second leg assembly for pivotal movement about the third pivotal axis; and further stabilizing feet comprising a further stabilizing foot at the lower end of each leg of the second leg assembly, each further stabilizing foot extending transverse to the length of a corresponding leg;

whereby upon placement of the second leg assembly in the respective unfolded configuration, the first and second platform constructs are aligned in the horizontal orientation, extended along the substantially horizontal common line, thereby establishing the platform supported along the substantially horizontal common line at the elevated location by the support base, and upon selective raising of the fourth pivotal axis to the elevation above the second and third pivotal axes to move the second leg assembly into the respective folded configuration, the first and second platform members are moved pivotally about the respective second, third and fourth pivotal axes, out of the horizontal orientation and into the overlapping vertical orientation, supported by the standard, having an extended basal footprint provided by the stabilizing feet, thereby establishing the valet stand.

13. The furnishing of claim 12 wherein the stop construct comprises further confronting stop abutments placed at the second, third, further and still further pivotal connections and arranged for engagement to preclude downward movement of the platform below the elevated location.

14. The furnishing of claim 12 wherein the stop construct comprises an arrangement wherein the fourth pivotal axis is positioned adjacent the second end of the second platform construct and located between the first and second ends of the first platform construct such that upon alignment of the first and second platform members in the horizontal orientation, the second end of the first platform construct is engaged with the second platform construct between the fourth pivotal axis and the third pivotal axis to preclude downward movement of the platform below the elevated location.

15. The furnishing of claim 12 wherein the stop construct comprises an arrangement wherein the first platform member extends from a first end adjacent the second pivotal axis to a second end spaced beyond the fourth pivotal axis toward the third pivotal axis, and the second platform member extends from a first end adjacent the third pivotal axis to a second end spaced from the fourth pivotal axis toward the third pivotal axis such that upon placement of the first and second platform constructs along the substantially horizontal common line the second end of the first platform member engages the second platform construct between the fourth pivotal axis and the third pivotal axis to preclude downward movement of the platform below elevated location.

16. The furnishing of claim 12 wherein the second end of the second platform member is spaced away from the fourth pivotal axis toward the third pivotal axis such that the second end of the first platform member engages the second platform construct between the second end of the second platform member and the fourth pivotal axis.

17. A method for selective conversion of a furnishing between a compact folded structure providing a valet stand, and an expanded unfolded structure providing a luggage rack, the method comprising:

providing a basal construct having at least a first leg assembly including first and second legs, the first and second legs each having a length extending between an upper end and a lower end;

coupling the first and second legs for pivotal movement about a first pivotal axis located intermediate the upper and lower ends of the first and second legs, between a folded configuration, wherein the upper ends are juxtaposed with one-another, and the lower ends are juxtaposed with one-another, thereby establishing a standard, and an unfolded configuration, wherein the upper ends are spaced apart longitudinally from one-another, and the lower ends are spaced apart longitudinally from one-another, thereby establishing a support base;

providing a first platform construct having a first end, a second end spaced longitudinally from the first end, laterally spaced apart sides and a first platform member extending longitudinally between the first end and the second end of the first platform construct;

coupling the first platform construct with the first leg of the leg assembly for pivotal movement about a second pivotal axis located adjacent the first end of the first platform construct in juxtaposition with the upper end of the first leg of the leg assembly;

providing a second platform construct having a first end, a second end spaced longitudinally from the first end, laterally spaced apart sides and a second platform member extending between the first end and the second end of the second platform construct;

coupling the second platform construct with the second leg of the leg assembly for pivotal movement about a third pivotal axis located adjacent the first end of the second platform construct in juxtaposition with the upper end of the second leg of the leg assembly; and coupling the first and second platform constructs with one-another for pivotal movement about a fourth pivotal axis located between the second and third pivotal axes;

whereby upon placement of the leg assembly in the unfolded configuration, the first and second platform constructs are aligned in a horizontal orientation, extended along a substantially horizontal common line, with the second end of the first platform construct juxtaposed with the second platform construct, establishing a platform supported along the substantially horizontal common line at an elevated location by the support base;

positioning a stop construct with respect to at least one of the first pivotal axis, the second pivotal axis, the third pivotal axis, and the fourth pivotal axis, to preclude downward movement of the platform below the elevated location, thereby establishing the luggage rack; and providing stabilizing feet comprising a stabilizing foot at the lower end of each leg, and extending each stabilizing foot transverse to the length of a corresponding leg;

whereby upon selectively raising of the fourth pivotal axis to an elevation above the second and third pivotal axes to move the leg assembly into the folded configuration, the first and second platform members are moved pivotally about the respective second, third and fourth pivotal axes, out of the horizontal orientation and into an overlapping vertical orientation, and the first and second legs are moved to establish the standard supported by an extended footprint provided by the stabilizing feet, thereby establishing the valet stand.

18. The method of claim 17 including placing confronting stop abutments at least at one of the second and third pivotal connections arranged for engagement to preclude downward movement of the platform below the elevated location.

19. The method of claim 17 including placing confronting stop abutments at both of the second and third pivotal connections arranged for engagement to preclude downward movement of the platform below the elevated location.

20. The method of claim 17 including positioning the fourth pivotal axis adjacent the second end of the second platform construct and between the first and second ends of the first platform construct such that upon alignment of the first and second platform members in the horizontal orientation, the second end of the first platform construct is engaged with the second platform construct between the fourth pivotal axis and the third pivotal axis to preclude movement of the platform below the elevated location.

21. The method of claim 17 including extending the first platform member from a first end adjacent the second pivotal axis to a second end spaced beyond the fourth pivotal axis toward the third pivotal axis, and extending the second platform member extending from a first end adjacent the third pivotal axis to a second end spaced from the fourth pivotal axis toward the third pivotal axis such that upon placement of the first and second platform constructs along the substantially horizontal common line the second end of the first platform member is engaged with the second platform construct between the fourth pivotal axis and the third pivotal axis to preclude downward movement of the platform below elevated location.

22. The method of claim 21 including spacing the second end of the second platform member away from the fourth pivotal axis toward the third pivotal axis such that the second end of the first platform member is engaged with the second platform construct between the second end of the second platform member and the fourth pivotal axis.

* * * * *